United States Patent [19]

Sighieri et al.

[11] 4,114,790

[45] Sep. 19, 1978

[54] DEVICE FOR CAPTURING AND REMOVING TEXTILE YARNS, BY SUCTION AND PNEUMATIC ENTRAINING

[75] Inventors: Pierluigi Sighieri, Scarperia; Gianfranco Colleoni, Castelmonte, both of Italy

[73] Assignee: UTITA S.p.A. Officine e Fonderie di Este, Milan, Italy

[21] Appl. No.: 788,636

[22] Filed: Apr. 18, 1977

[30] Foreign Application Priority Data

Apr. 23, 1976 [IT] Italy ..... 22592 A/76

[51] Int. Cl.[2] ..... B65H 17/32

[52] U.S. Cl. ..... 226/91; 226/97

[58] Field of Search ..... 226/91, 95, 97

[56] References Cited

U.S. PATENT DOCUMENTS

| | | | |
|---|---|---|---|
| 3,452,910 | 7/1969 | Richter | 226/99 X |
| 3,683,732 | 8/1972 | Juppet | 226/97 X |
| 3,690,530 | 9/1972 | Porter | 226/97 |
| 3,718,270 | 2/1973 | Parmeggiani | 226/97 |

*Primary Examiner*—Richard A. Schacher

*Attorney, Agent, or Firm*—Wenderoth, Lind & Ponack

[57] ABSTRACT

A device for suctionally capturing textile yarns and then carrying away the same by pneumatic entrainment, is supplied with pressurized air and includes tubular components which are movable with respect to each other from first position whereat thereof a strong suction action is exerted in a space adjacent to a suction nozzle for capturing a yarn, to a second position whereat a strong yarn entraining action is exerted into and along passages downstream of the nozzle for carrying the captured yarn to a yarn collecting environment. The device includes operator controlled means for switching the device from one to the other of the two relative positions and modes of operation.

12 Claims, 7 Drawing Figures

DEVICE FOR CAPTURING AND REMOVING TEXTILE YARNS, BY SUCTION AND PNEUMATIC ENTRAINING

BACKGROUND OF THE INVENTION

The present invention relates to devices, in particular of the type which can be used by manually gripping and manipulating them, employed in the so-called "take up" of textile yarns, and adapted to capture yarn delivered from spinnerets, at a high linear speed, and therefore to allow "threading-up" of the yarn onto bobbin winding machines for continuos yarn.

These operations are well known in the art of spinning, collecting and winding up continuous artificial and/or synthetic yarns, and therefore require no description. Suffice it to note that devices of the aforesaid broad definition are known.

Essentially, these devices (also called "pneumatic guns") comprise, in unit which can be manually gripped and manipulated, a system of conduits and passages, including a front orifice constituting the inlet of a nozzle, which extends within the device itself, with a passage connected to an element, such as a vessel, for collecting the captured and removed yarn. The system, fed from a suitable source of pressurized air and optionally of vacuum or depression, is such that a pneumatic depression is established in the zone situated in front and in the vicinity of the nozzle orifice, such depression being sufficient to assure that the yarn, to which the device is presented and approached, is captured and drawn into and through the nozzle, and that thereafter a swift current of air, directed towards the collecting element, is established and maintained in the passage, the yarn thus captured being entrained in the current towards the collecting element, until the threading-up operation has been completed.

To simplify the feeding operation, such devices are connected only to a source of air under pressure, which is introduced at a point of the passage, downstream of the nozzle orifice in such a way that by the so-called "venturi" principle, such introduction of air at a high speed creates upstream of the point of introduction, a depression which in turn causes outside air to be drawn into the nozzle, with an intensity sufficient to capture the yarn and drawn it into the nozzle. The yarn, once it has reached the point of introduction of the air, is entrained in the air current which flows therefrom towards and into the collecting element.

It is obvious that such devices must be adapted to operate, during the course of the yarn capturing and entraining operations, under successive conditions which theoretically should correspond to different and pneumatically contrasting effects, and precisely:

(a) in the initial yarn capturing stage it is essential that there be established and maintained at the nozzle orifice a deppression of such an intensity as to promptly capture the yarn to which the orifice is approached, to promptly suck the yarn inwardly and cause it to proceed within the nozzle up to the point from which the "entraining" air current is established and maintained;

(b) once the yarn has been captured, the essential condition which the device must fulfil is that an entraining air current be established and maintained in the passage downstream of the nozzle, to which yarn has been conveyed because of its having been captured, such entraining air current having a uniformity and a speed such as to assure that the yarn is efficiently drawn away from the spinnerets, at a tension sufficient to withstand with certainty its passage through the various organs of the collecting machine.

It has been recognized that, no matter what the geometry chosen for the Venturi system, and unless the device is fed with air at technically and economically unacceptable flow rates and pressures, it is practically impossible to obtain a device which will fulfil both the above indicated conditions, and more precisely which will be capable of concurrently producing and maintaining a very strong upstream depression assuring an intense suction of outside air and a swift and uniform downstream air current for entraining and removing the yarn at the desired speed, for the satisfactory and secure execution of the first and second stages, respectively.

Technical solutions have been proposed for this problem which include forming the pneumatic system with components which can be actuated for displacement with respect to each other, so as to modify the geometric parameters of the Venturi system to better adapt it, at least within certain limits, to operate in succession under the conditions in which it is desired to suck in the yarn and to entrain it in the air current, respectively. Such solutions however have not heretofore provided satisfactory with respect to efficiency and yield, in particular with respect to the feed pneumatic pressure.

SUMMARY OF THE INVENTION

Now then, it is an object of this invention to provide a device of the type and for the uses described, and equivalent ones, improved in such a way as to have a high efficiency in all its service conditions, such efficiency being expressed in terms of depression applied to the nozzle orifice and of tension applied to the captured yarn, respectively, as a function of the feed pressure. It is also an object of the invention to provide a device which is improved in that it associates the above indicated advantageous performance with the capability of being promptly switched over from the one to the other of its different operating conditions.

Essentially, the present invention includes a device of the type and for the uses indicated, including, in succession along the passage through which the captured yarn travels, a fixed component defining the nozzle for capturing the yarn and a mobile component forming in its interior the initial part of the entrainment conduit. The second, mobile component is adapted to be displaced rearwards with respect to the first fixed component against opposing elastic means. The downstream portion of the fixed component and the upstream portion of the mobile component axially overlap one another to a variable extent and define therebetween a passage constituted by a short annular conduit having basically frusto-conical inner and outer walls (with convex connecting curvatures) and having conicities extending in the same direction. The maximum diameter of the outer surface of the downstream portion of the fixed component is less than the minimum diameter of the inner surface of the upstream portion of the mobile component so that a forwardly displacement of the mobile component tends to bring the two surfaces closer together, thereby narrowing the annular conduit. The components are mounted to be relatively displaceable with respect to each other in the axial direction, between a foremost (maximum overlap) position and a rearmost (minimum overlap) position of the mobile component. The following characteristic geometric conditions are also fulfilled:

Foremost (maximum overlap) position:

The annular conduit, as defined in any axial cross-section, comprises an initial sharply convergent portion and final sharply divergent portion. The cross-section of the annular conduit having the smallest area is annular, is very small, and is defined between significantly convex opposed surfaces. The minimum distance between the opposed surfaces in such cross-section is preferably between 0.2 and 1 mm, and preferably in the order of 0.5 mm, for an outer diameter in the order of 8 mm.

Rearmost (minimum overlap) position:

The downstream end surface or the downstream outlet port of the nozzle is located on a transverse plane intersecting the inlet portion of the mobile component at a point at which such inlet portion is still markedly convergent, so that the short annular conduit formed between the two components is sharply convergent throughout its length, with a larger convergence angle on its outer surface. The cross-section of the annular conduit having the smallest area is on the plane of the outlet port of the nozzle component. The minimum distance between the overlapping convergent surfaces defining the annular conduit on such plane is from 5 to 10 times (preferably in the order of 8 times) greater than the minimum distance between the surfaces in the aforesaid foremost (maximum overlap) position.

BRIEF DESCRIPTION OF DRAWINGS

These and other important characteristics of the improved device, together with some hypotheses not bindingly suggested by the Applicant as a possible explanation of the surprisingly high areodynamic efficiency thereof, will become apparent in the course of the following detailed description of a preferred but not limitative embodiment of the invention, with reference to the attached drawings, wherein.

DETAILED DESCRIPTION OF THE INVENTION

Figure 1:
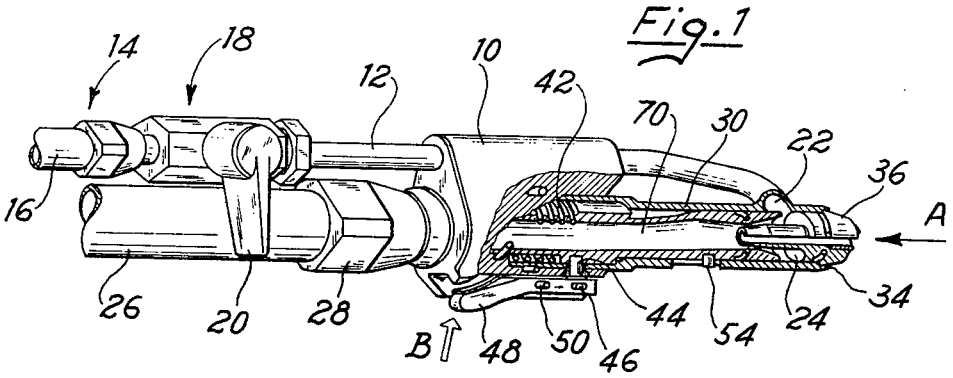
FIG. 1 represents in perspective view the device according to the inventions with positions thereof cut off along planes passing through the axis of the successive passages and conduits through which the yarn travels, the device being illustrated with the mobile component in its foremost position.
Figure 2:
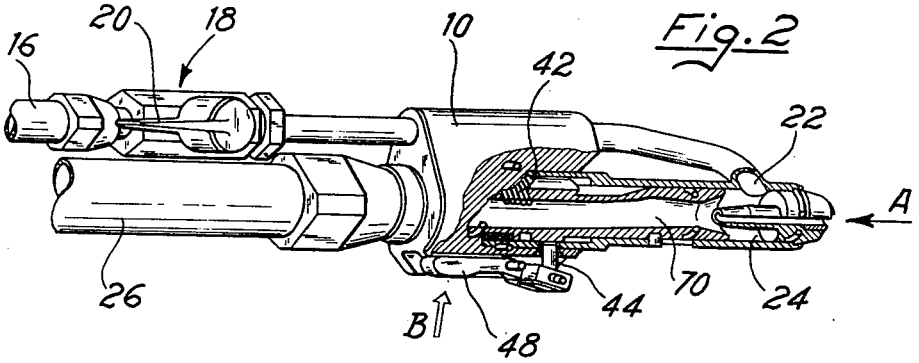
FIG. 2 represents, in the same view as FIG. 1, the same device with the mobile component in its rearmost position.
Figure 3:
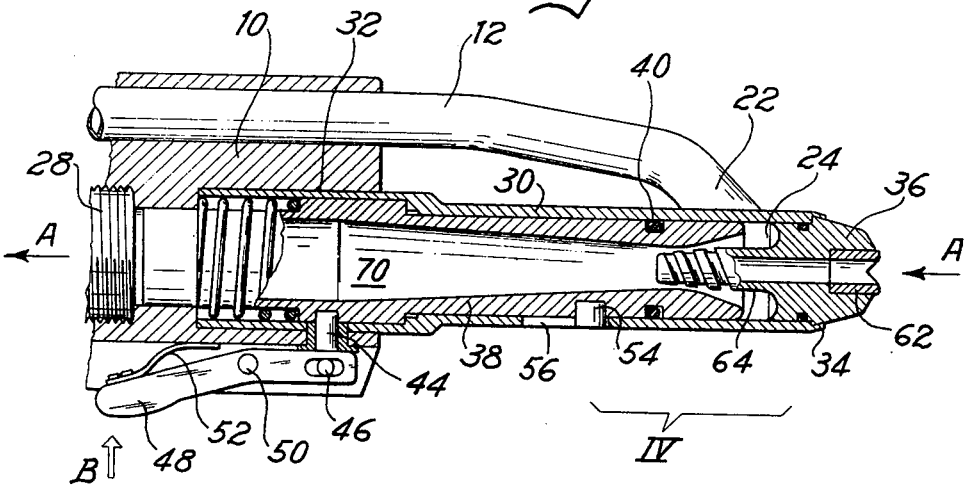
FIG. 3 represents, in longitudinal cross-section on its plane of symmetry, and on a larger scale, the front portion of the device, with the mobile component in its foremost position.

Altogether, and as can be seen in particular in FIGS. 1 to 3, the device is constituted by a unit so dimensioned as to be adapted to be easily gripped with one hand, and structurally formed by a body 10 which carries the systems of air feed conduits and passages and of means for capturing the yarn and removing the captured yarn, respectively. The term "yarn" obviously includes any type of artificial or synthetic yarn, and also groups or bundles of single filament or multifilament yarns.

The feed conduit is basically constituted by a plain tube 12 joined at 14 (FIG. 1) to a (generally flexible) conduit 16 for connecting the device to a suitable source of air (or another gas) under pressure. The feed conduit has a suitable cock or valve 18 provided with control organs for discontinuing and for activating the feed flow. The conduit has an outlet at 22 into a chamber 24, hereinafter described.

The conduits and passages for capturing and removing the captured yarn are all coaxial and are aligned along the general axis A—A of the system, and end in an outlet tube 26 connected to the body 10, immediately downstream of the significant and characteristic components of the unit. This tube, which is also flexible, extends far enough to introduce the captured and removed yarn into a suitable collecting element (not shown).

As better seen in FIG. 3, the properly operative portion of the device comprises a fixed structural component, constituted by a sleeve or casing 30 engaged, e.g. by screw coupling, with the rear (or downstream) portion 32 of body 10. To the front (or upstream) end of this sleeve is connected a shaped head 36 which constitutes the nozzle which is presented to the yarn and which captures and sucks the yarn into the device. Head 36 is attached, e.g. by crimping the front end of sleeve 30, as at 34. Within the sleeve 30 is slidably mounted a mobile structural component constituted by a tubular sleeve 38. Sealing rings 40 are also provided to assure airtightness between the components 30 and 38 which are mobile with respect to one another. The inner mobile sleeve 38 is urged forwards, viz. towards fixed head 36, by an elastic means, such as a spring 42, and is also retained in its position of maximum forwardly displacement (also called "foremost position"), as shown in FIGS. 1 and 3, by the engagement of a pawl 44 in a recess (possibly an annular groove) formed on the outside of the mobile sleeve 38. Pawl 44 is hingedly connected at 46 to a small lever 48 which is swingably mounted at 50 to body 10. A second elastic means, such as a lamina 52, urges lever 48 in a direction tending to cause pawl 44 to become engaged in the recess in sleeve 38.

In the position indicated in FIGS. 1 and 3, the inner slidable sleeve 38 is therefore locked in its foremost position, while if the protruding end of the small lever 48 is depressed in direction B, inner sleeve 38 becomes disengaged and may move backwards, and will so move if impelled by a force greater than the reaction of the spring 42. A pin 54, rigidly connected with the inner sleeve 38 and slidable in an elongated slot 56 formed in the fixed outer sleeve 30, limits the amplitude of the rearwardly motion of sleeve 38, particularly to the extent observable in FIGS. 2 and 5.

Figure 4:
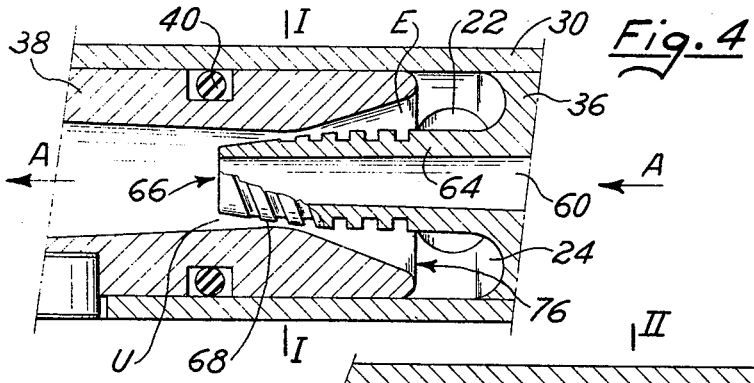
FIGS. 4 and 5 represent, in cross-section on an axial plane and on a further enlarged scale, the portion of the device indicated by IV in FIG. 3, with the mobile component in its foremost and rearmost positions respectively.
Figure 5:
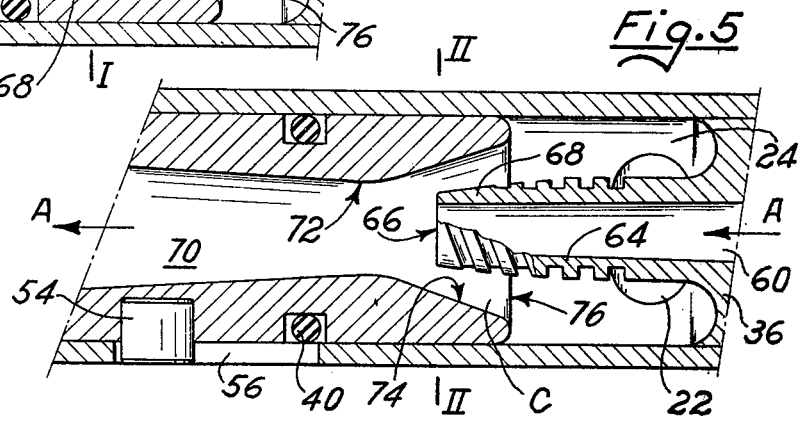

The characteristics of the improved device which are believed to contribute most to its high efficiency are observable in FIGS. 4 and 5, in which the hereinbefore described components (fragmentarily reproduced) are identified by the same reference numerals.

The head or fixed component 36 is axially traversed by a cylindrical bore 60 having a relatively short length. Preferably, the inlet of the bore 60, which constitutes the nozzle through which the yarn is sucked in at high speed, has an annular gasket 62 (FIG. 2) of a material which is highly resistant to wear and which is easily slidable, e.g. a material of the ceramic type.

A tube-like extension 64 of head 36 extends inwardly of the device and has an outer diameter which is much smaller than the inner diameter of the fixed sleeve 30 and ends with a flat end surface 66 which defines the downstream outlet of bore 60. The outer surface of element 64 is initially cylindrical and then tapered at 68 as it nears end surface 66, with a small but significant conicity having its vertex facing downstream, in the direction of travel of the seized and indrawn yarn, which direction is indicated by arrows marked on the axis A—A of the device.

The interior of the mobile inner sleeve 38 forms a passage. The major portion 70 of the length of the passage is the downstream portion thereof which is significantly divergent in the downstream direction, but with a small divergence angle. This long divergent portion 70 merges upstream, through convex surface or choke 72 (FIG. 5), with a portion 74 which is sharply convergent in the downstream direction. The upstream end of portion 74 forms a broad inlet or opening 76 into chamber 24. The expressions "convergent" and "divergent" always refer to the direction of travel of the yarn.

Preferably, the tapered end portion 68 of tube-like element 64 has, at least along part of its length, a helical groove, generally formed by a square multiple screw thread for imparting a rotary motion to the high speed air flow and for thus improving the discharge of the yarn, which aquires a spiral-like configuration while it travels through the passages downstream from portion 68.

In the foremost position of the inner sleeve 38, the choke 72 is positioned closely adjacent the outer surface of the fixed head 36, in particular at a point (in the transverse plane I—I of FIG. 4) wherein such outer surface preferably has a substantial convexity connecting its cylindrical and tapered portions. Therefore, starting from chamber 24, and proceeding in a downstream direction a tubular conduit is formed between the two components 36 and 38, which conduit, as is observable in FIG. 4, has an inlet segment E having strongly convergent walls, an annular segment of minimum cross-section (on plane I—I) and a strongly divergent outlet segment U, which however has an inner wall (the outer surface of portion 68) which is markedly convergent in the downstream direction.

When the mobile component 38 is displaced as far back as it can go, viz., to its rearmost position, the flat end surface 66 of the fixed head 36 lies on a transverse plane II—II which intersects the still convergent (always in the direction) portion of the inlet portion 74 of the passage through mobile sleeve 38. Therefore, between the axially overlapping portions of the two components, there is formed in this case a short completely convergent passage C, the minimum cross-section of which lies on plane II—II and coincides with the inner outlet 66 of the cylindrical suction bore 60.

It is further to be noted that the minimum passage area (on plane I—I of FIG. 4) of the annular "convergent E - divergent U" conduit is much smaller than the minimum area (on plane II—II of FIG. 5) of the completely convergent annular passage C.

It is noted further that even when the inner mobile sleeve 38 is completely displaced forwards (FIGS. 1, 3 and 4) a relatively large annular space, constituting the aforementioned chamber 24, is always formed between the components 36 and 38 and about the extension 64 of the fixed head. Further, the inlet 76 of the convergent segment of the mobile component 38 and the opposed bottom wall of chamber 24 are shaped in such a way that the air flow arriving at 22 through the feed tube 12 can pass into, in an uniform manner and with a minimum of turbulence, the chamber 24, so as to reach the inlet 76 of the passage or short annular conduit formed between the extension 64 of the fixed head 36 and the initial segment of the mobile sleeve 38.

Assuming that the device is in the position of maximum forwardly displacement of FIGS. 1, 3 and 4, and that the cock 18 is open, then first of all there is established within chamber 24 a pneumatic pressure practically equal to the feed pressure, due to the strong pressure loss which occurs through the small annular passage cross-section, i.e. on plane I—I. The mobile inner sleeve 38 is therefore subjected to a thrust in the downstream direction equal to such pneumatic pressure multiplied by the area defined by the inner diameter of the outer fixed sleeve 30 and the area circumscribed by the annular passage on the plane I—I. The spring 42 (FIGS. 1 to 3) is adjusted in such a way that it cannot withstand this thrust, but on the other hand the engagement of the pawl 44 prevents the inner slidable sleeve from moving backwards. During the first stage (of capturing the yarn) of the use of the device, the aerostatically and aerodynamically cooperating parts are in the condition of FIG. 4. In this condition, a thin, very fast annular jet escapes through the small annular passage cross-section on plane I—I, the jet expanding in the divergent outlet segment U, but with a mean direction converging on the axis A—A of the device. This condition is the most favourable because in the zone immediately downstream of the outlet end 66 of the cylindrical bore 60 a very strong depression becomes established, by a phenomenon broadly comparable to that typical of "Venturi tubes." Therefore, in the external zone close to the inlet of the bore 60 in head 36, a strong air suction is generated. This suction is adapted to capture and promptly to suck into bore 60 the yarn adjacent which the head 36 is positioned.

When the operator has checked that the yarn is properly captured, he exerts a pressure in the direction B on the small lever 48, thus freeing pawl 44. From this moment, the slidable inner sleeve 38 is subjected to a restraining force only by the opposing force of the spring 42, and thus sleeve 38 is allowed to move in a downstream direction it occupies the position of maximum rearward displacement, represented in FIGS. 2 and 5, due to the thrust applied by the pressure in the chamber 24.

In this position, the aerodynamic conditions of the device become inverted. The air under pressure which enters chamber 24 can pass, at a substantial flow rate, through the much wider convergent passage C of FIG. 5, in directions converging in a downstream direction onto the axis A—A of the device, wherein the captured yarn is already present. This increased flow of air completely fills the cross-section of the divergent segment 70, while the effect of drawing air into the cylindrical bore 60 is sharply reduced, and, in practice, may be completely stopped at sufficiently high feed pressures. This phenomenon prevents the subsequent suction of air through bore 60 from disturbing the filling of the divergent segment 70 (and of the subsequent conduit for the removal of the captured yarn) by the current to air which flows from the chamber 24.

Since the entraining of the yarn occurs by virtue of the surface friction between the yarn itself and the air current into which it is introduced, the most favourable conditions are thus established for drawing in and removing the yarn, while applying thereto a tension such as to guarantee the sureness and the continuity of the drawing-in operation.

Obviously, once the threading-up operation has been completed, the operator closes the cock 18 and discontinues the feed of air. In this case, the removal of the pressure in chamber 24 permits the spring 42 to bring the inner slidable sleeve 38 back to its totally advanced position, causing it to be engaged once again by the pawl 44. The device is thus in a condition to repeat the work cycle.

Figure 6:
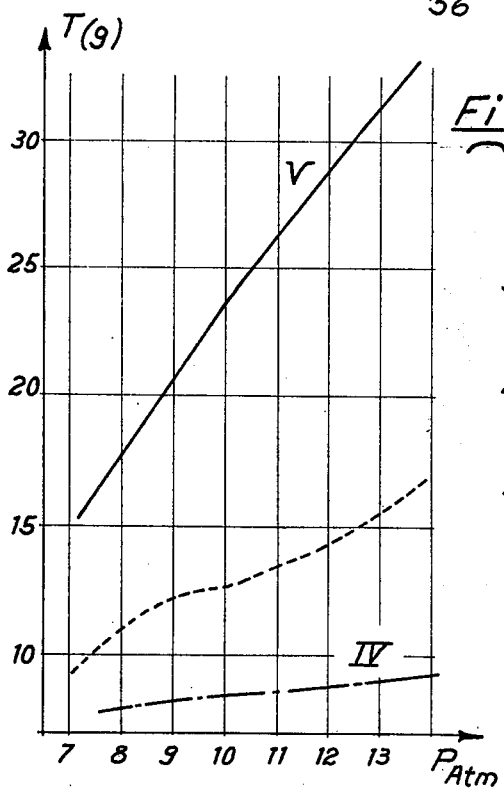
FIGS. 6 and 7 are cartesian diagrams wherein curves are shown, and the comparison of which evidences the improved efficiency of the device according to the invention in both its operating conditions.
Figure 7:
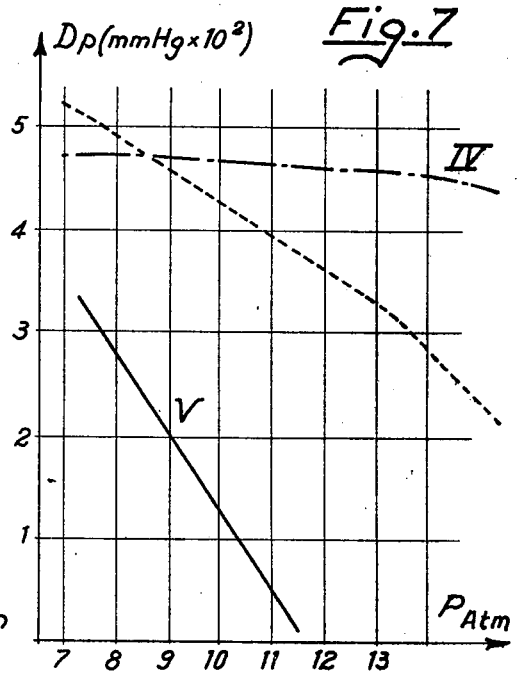

The high efficiency of the device, in both the conditions described, appears evident from an examination of the diagrams of FIGS. 6 and 7, wherein the curves reproduced in dash-and-dot lines indicated with IV correspond to the effects obtained with the device having the inner sleeve completely displaced forwardly, i.e. as shown in FIG. 4, whereas the continuous line curves V correspond to the conditions of FIG. 5 with the sleeve totally displaced backwards, viz. to the conditions of "capturing" and of "drawing in and removing," respectively.

The graph of FIG. 6 indicates the tension $T_{(g)}$ which is applied to a 100 denier yarn, as a function of the feed pressure $P_{Atm}$, expressed in atmospheres above room pressure.

The curves of the graph of FIG. 7, on the other hand, indicate the variation, always as a function of the feed pressure, of the depression $D_P$, measured in mm Hg $\times 10^2$, measured at the head inlet.

For comparison, the corresponding variations of the tension and of the depression in a known fixed geometry device, are indicated by short segmented broken lines.

It will be observed that in the condition of FIG. 4, a strong suction, which is a function of the depression, is obtained, such suction being practically constant for the different feed pressures, while in the condition of FIG. 5 the suction falls rapidly with the pressure. Also in FIG. 4, it will be seen that the drawing-in tension (which is not important during yarn capture) is low, while in the condition of FIG. 5, after the yarn capture, the drawing-in tension rises almost linearly as a function of the pressure. These phenomena are easily understandable since, in the situation of FIG. 5, the long divergent segment 70 and the segments downstream therefrom are completely filled by an air current the speed of which is proportional to the pressure applied, and since the tension exerted on the yarn is in turn proportional to the entrainment of the yarn by friction with the air, due to the difference between the speed of the entraining air current and the speed at which the yarn is delivered by the spinning apparatus. It will be observed from the comparison of lines IV and V with the short segmented lines representing conventional devices, that there are great increases in efficiency obtainable with the present device, as compared with devices currently used.

We claim:

1. A device for initially picking up and then removing textile yarns, said device comprising:

a hollow casing having first and second ends;

a nozzle head fixedly attached to said first end of said casing;

an outlet tube in communication with said second end of said casing;

a movable sleeve slidably positioned within the interior of said casing, said sleeve being axially slidable within said casing between a foremost first position relatively adjacent said nozzle head and a rearmost second position relatively spaced from said nozzle head, said sleeve having an axial passage therethrough, said axial passage including a first portion relatively adjacent said nozzle head and a second portion relatively spaced from said nozzle head, said first portion being defined by a first frusto-conical surface which sharply converges in a direction toward said second portion, said second portion being defined by a second frusto-conical surface which diverges in a direction away from said first portion;

said nozzle head having a fixed tube-like extension extending into the interior of said casing, said nozzle head and said extension having extending therethrough a bore opening into said interior of said casing, said extension having an outer surface including a cylindrical portion adjacent said nozzle head and a frusto-conical portion connected to said cylindrical portion and converging radially inwardly in a direction away therefrom, said frusto-conical portion ending in a nozzle outlet;

said extension extending into said passage of said sleeve and defining therewith an annular passage;

said nozzle head and the adjacent end of said sleeve defining therebetween a chamber, said chamber coaxially surrounding said extension and communicating with said annular passage;

said sleeve, when in said first position thereof, cooperating with said extension such that said annular passage comprises an initial convergent segment and a final divergent segment, said initial convergent segment being defined by said cylindrical surface of said extension and said first frusto-conical surface of said sleeve, and said final divergent segment being defined by said frusto-conical portion of said extension and said second frusto-conical surface of said sleeve;

said sleeve, when in said second position thereof, cooperating with said extension such that said nozzle outlet is located at a position between the opposite axial ends of said first frusto-conical surface of said sleeve, and such that said annular passage is completely convergent and is defined by said frusto-conical portion of said extension and said first frusto-conical surface of said sleeve; and means for supplying pressurized gas into said chamber, such that when said sleeve is in said first position thereof a relatively small quantity of gas passes from said chamber through said annular passage at a relatively high pressure, thus creating a reduced pressure in said bore so that a yarn may be picked up and drawn therethrough, and such that when said sleeve is in said second position thereof a relatively greater quantity of gas passes from said chamber through said annular passage at a relatively lower pressure, thus pulling the picked up yarn through said passage of said sleeve and into said outlet tube, while substantially avoiding the creation of a reduced pressure in said bore.

2. A device as claimed in claim 1, wherein said second portion of said axial passage through said sleeve has a longer axial length than said first portion.

3. A device as claimed in claim 1, wherein said first and second frusto-conical surfaces of said sleeve smoothly merge at and are joined by a curved radially inwardly extending surface which, when said sleeve is in said first position thereof, forms an annular constriction between said initial convergent segment and said final divergent segment of said annular passage.

4. A device as claimed in claim 1, wherein the minimum distance between adjacent surfaces of said sleeve and said extension, when said sleeve is in said second position thereof, is from five to ten times larger than the minimum distance between said adjacent surfaces when said sleeve is in said first position thereof.

5. A device as claimed in claim 4, wherein said minimum distance when said sleeve is in said first position thereof is between 0.2 and 1.0 mm.

6. A device as claimed in claim 5, wherein said minimum distance when said sleeve is in said first position thereof is 0.5 mm, and the outer diameter of said annular passage at the position of said minimum distance is approximately 8 mm.

7. A device as claimed in claim 1, further comprising helical grooves formed in at least one of said surfaces defining said annular passage, to thereby impart a rotary motion to the flow of gas passing through said axial passage of said sleeve.

8. A device as claimed in claim 7, wherein said helical grooves comprise square worm, multiple threads formed in said cylindrical portion and said frusto-conical portion of said extension.

9. A device as claimed in claim 1, further comprising elastic means for urging said sleeve into said first position thereof.

10. A device as claimed in claim 9, wherein the urging force of said elastic means is less than the force exerted on said sleeve by said pressurized gas, such that said gas tends to move said sleeve toward said second position thereof against the force of said elastic means.

11. A device as claimed in claim 10, further comprising means for locking said sleeve in said first position thereof against the force of said pressurized gas, said locking means being manually operable to unlock said sleeve and allow said sleeve to be moved to said second position thereof by said pressurized gas, and said elastic means being capable of automatically moving said sleeve from said second position to said first position thereof upon the termination of the supply of said pressurized gas, whereby said locking means is then capable of automatically re-engaging to lock said sleeve in said first position thereof.

12. A device as claimed in claim 11, wherein said locking means comprises a recess in the exterior of said sleeve, a pawl pivotally mounted exteriorly of said casing and adapted to move from a first position exterior of said casing to a second position extending through said casing and fitting into said recess, and means for urging said pawl into said second position thereof.

* * * * *